US005199865A

United States Patent [19]

Liang

[11] Patent Number: 5,199,865

[45] Date of Patent: Apr. 6, 1993

[54] STRUCTURRE OF FOLDABLE SAFETY LIGHTER

[76] Inventor: Chung-Ho Liang, 5F-23, 70, Fu-Shing Road, Taoyuan, Taiwan

[21] Appl. No.: 740,083

[22] Filed: Aug. 5, 1991

[51] Int. Cl.[5] ..... F23Q 7/12

[52] U.S. Cl. ..... 431/255; 431/264; 219/262; 361/260

[58] Field of Search ..... 431/254, 255, 277, 153; 219/260, 262, 261, 383; 361/260, 261

[56] References Cited

U.S. PATENT DOCUMENTS 3,947,731 3/1976 Vainer ..... 431/255
4,538,983 9/1985 Zeller ..... 431/255

*Primary Examiner*—Larry Jones

*Attorney, Agent, or Firm*—Morton J. Rosenberg; David I. Klein

[57] ABSTRACT

A foldable safety lighter is provided having a locating block for securing a nozzle tube to a casing at either a first position, permitting the nozzle tube to be longitudinally extended outward from the casing, or a second position, permitting the nozzle tube to be rotated through 180° angle relative to said first position, so as to lie parallel to the casing for reducing storage space. A control knob is rotatable to a triggering position, to trigger a gas tube to discharge gas and simultaneously trigger an electric igniter to discharge sparks to ignite discharged gas from the gas tube. The control knob can be rotated to a locking position to prevent accidental triggering thereof.

3 Claims, 6 Drawing Sheets

STRUCTURRE OF FOLDABLE SAFETY LIGHTER

BACKGROUND OF THE INVENTION

The present invention relates to lighters, and more particularly to a gas lighter which can be extended out when in use or folded up when not in use and, which has a safety control mechanism to protect form error triggering.

Various structures of gas lighter have been disclosed in U.S. Pat. Nos. 4,023,922; 4,292,021; 4,502,465; and, 4,538,984. In these structures, a control circuit is triggered by a control knob to drive a gas container to discharge gas and simultaneously drive an electric igniter to make a fire. The common disadvantage of these structures is that fire will be produced when the control knob is triggered unintentionally. Therefore, a certain measure must be taken so as to lock the control knob when the device is not in use. Further, a gas lighter generally includes an elongated nozzle tube which must be elongated sufficiently so that the operator's hand is kept at a safe distance from the gas flames produced at the front end of said nozzle tube. Because of the design of the elongated nozzle tube, a gas lighter generally requires much space in storage.

SUMMARY OF THE INVENTION

The present invention has been accomplished under the circumstances in view. It is therefore an object of the present invention to provide a foldable safety lighter which can be folded up through revolving control to reduce space occupation when it is not in use.

It is another object of the present invention to provide a foldable safety lighter which has safety control means to lock the control knob, so as to prevent triggering the lighter accidentally.

It is still another object of the present invention to provide a foldable safety lighter which has a link means to automatically control a gas tube to discharge gas when the control knob is pressed down to trigger an electric igniter to discharge sparks.

DETAILED DESCRIPTION OF THE PREFERRED EMBODIMENT

Figure 1:
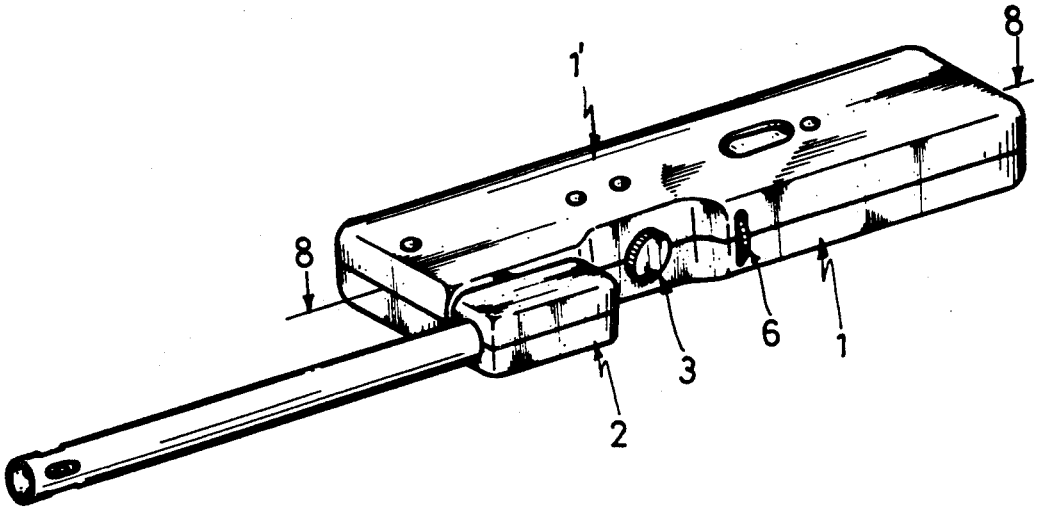
FIG. 1 illustrates the preferred embodiment of the foldable safety lighter of the present invention.
Figure 2:
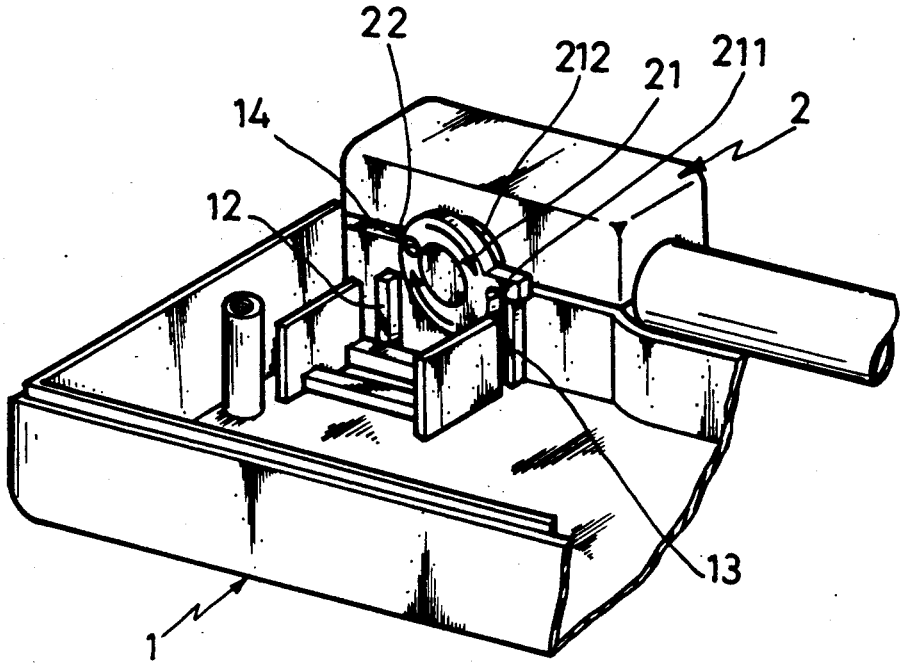
FIG. 2 illustrates that the locating block is rotated backwards through 180° angle to receive the nozzle tube.
Figure 3:
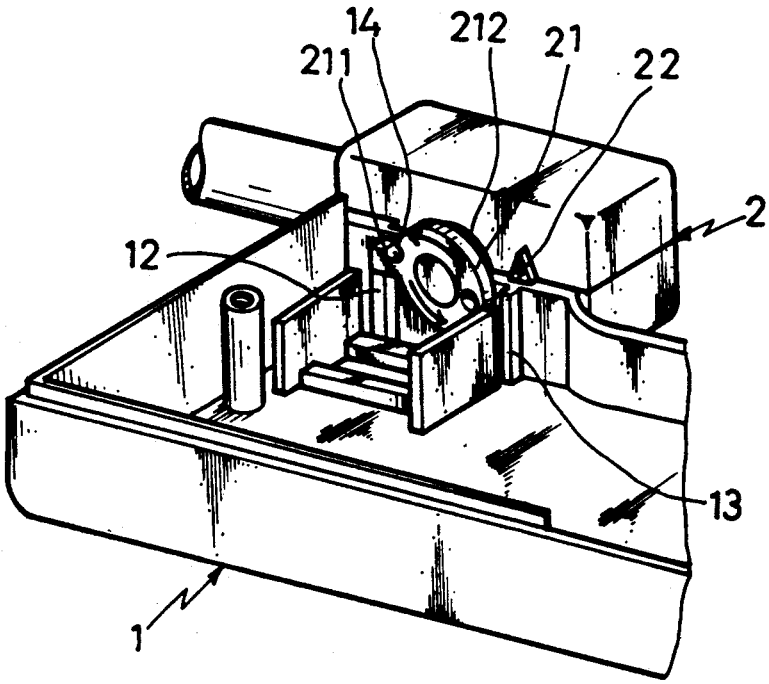
FIG. 3 illustrates that the locating block is rotated forward through 180° angle to extend out the nozzle tube.
Figure 4:
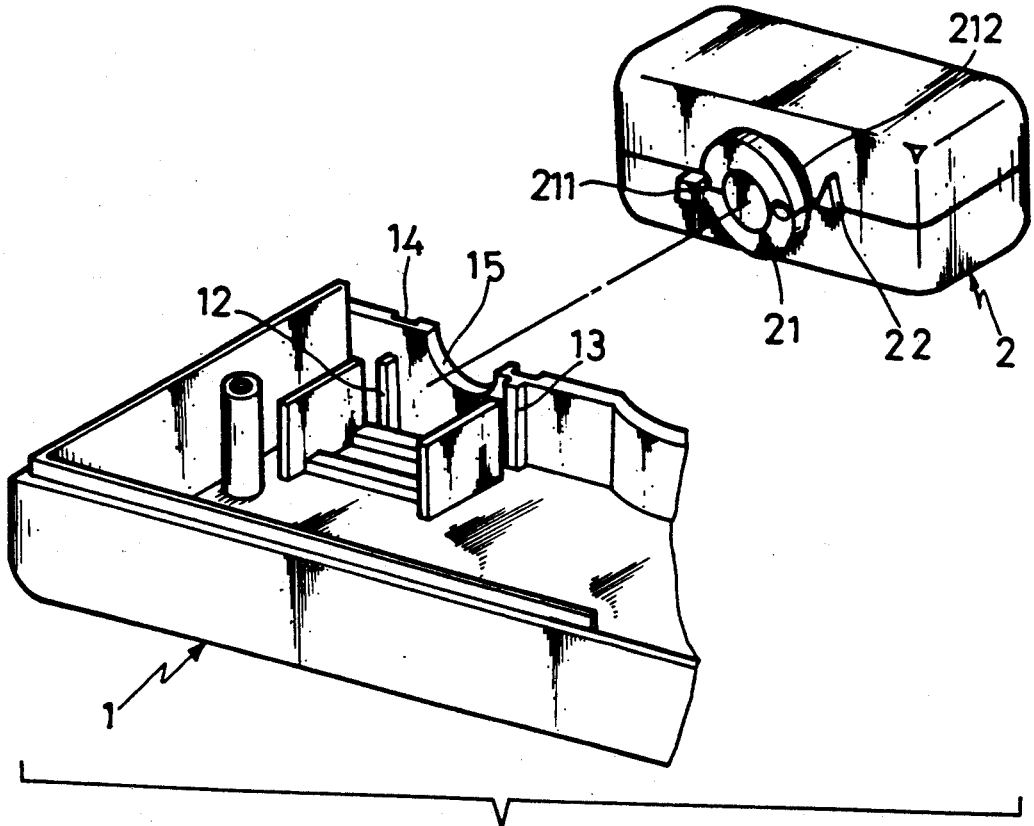
FIG. 4 is a perspective dismantled view of the locating block and one of the two outer shells of the housing.
Figure 5:
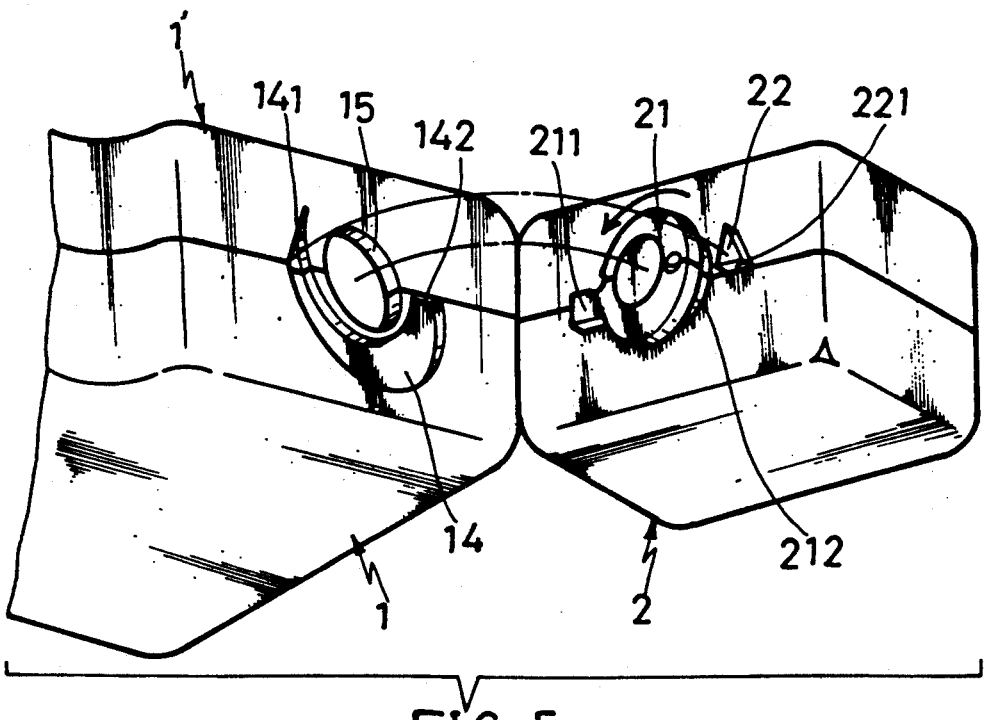
FIG. 5 is a schematic drawing showing the connection between the locating block and the housing.
Figure 6:
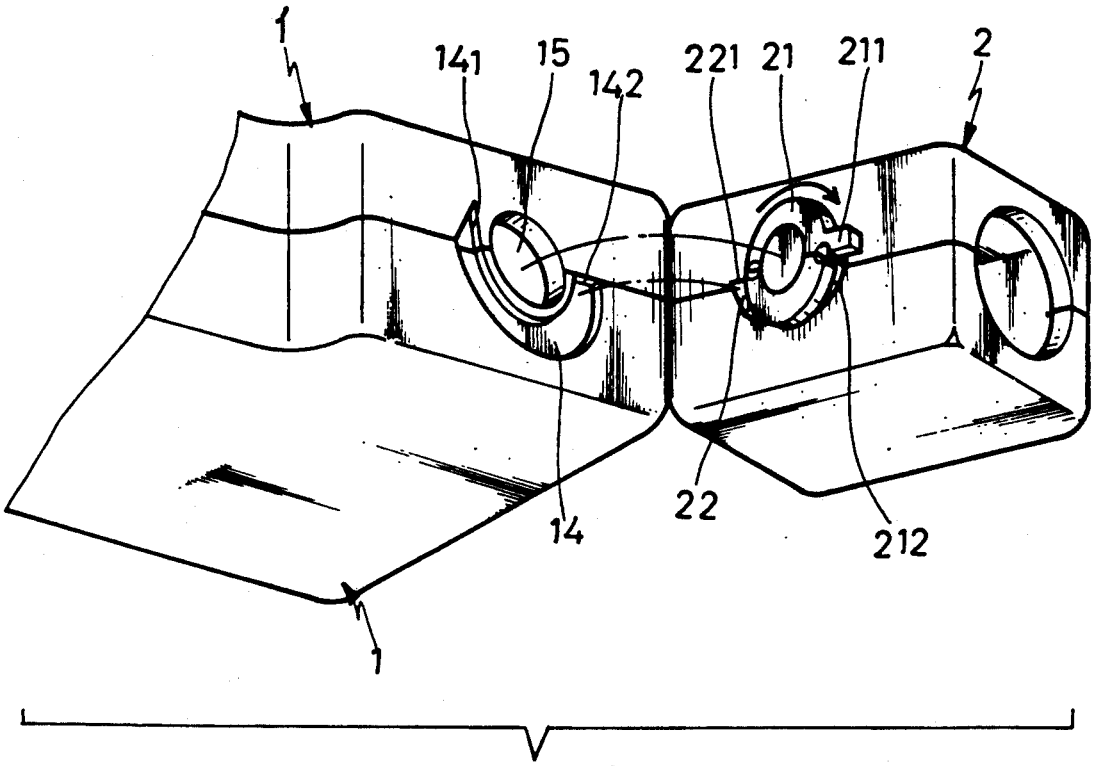
FIG. 6 is a schematic drawing showing the connection between the locating block and the housing, which is taken from another angle.

Referring to FIGS. 1 through 6, the housing of the preferred embodiment of the safety lighter of the present invention is generally comprised of two outer shells 1 and 1'. The outer shells 1 and 1' each have a semi-circular hole 15 at the top respectively aligned with each other to form a circular hole. The first outer shell 1 has two posts 12 and 13 interiorly disposed at two opposite sides of the semi-circular hole 15, and the semi-circular groove 14 formed on the outside of first outer shell 1 around the semi-circular hole 15. There is provided a locating block 2 attached to the outer shells 1 and 1', having a shaft 212, a flange 21 coupled to the revolving shaft 212, and a small triangularly shaped guide block 22 formed adjacent shaft 212. The flange 21 has a projecting strip 211 projecting outward from the periphery thereof at a suitable location. During assembly, the shaft 212 is inserted in the circular hole formed of the two semi-circular holes 15 of the two outer shells 1 and 1' with the flange 21 retained inside the housing of the outer shells 1 and 1'. After assembly, the projecting strip 21 is stopped at the post 12, the guide block 22 is engaged in a groove 141 having a substantially triangular contour, formed in the second outer shell 1' (see FIG. 5). When the locating block 2 is rotated through 180° relative to the outer shells 1 and 1', the projecting strip 211 is moved to stop at the other post 13 and the bottom 221 of the guide block 22 is moved to stop at the edge 142 of the second outer shell 1'. By means of the aforesaid arrangement, the outer shells 1 and 1' of the housing are protected from breaking during rotation of the locating block 2.

Figure 7:
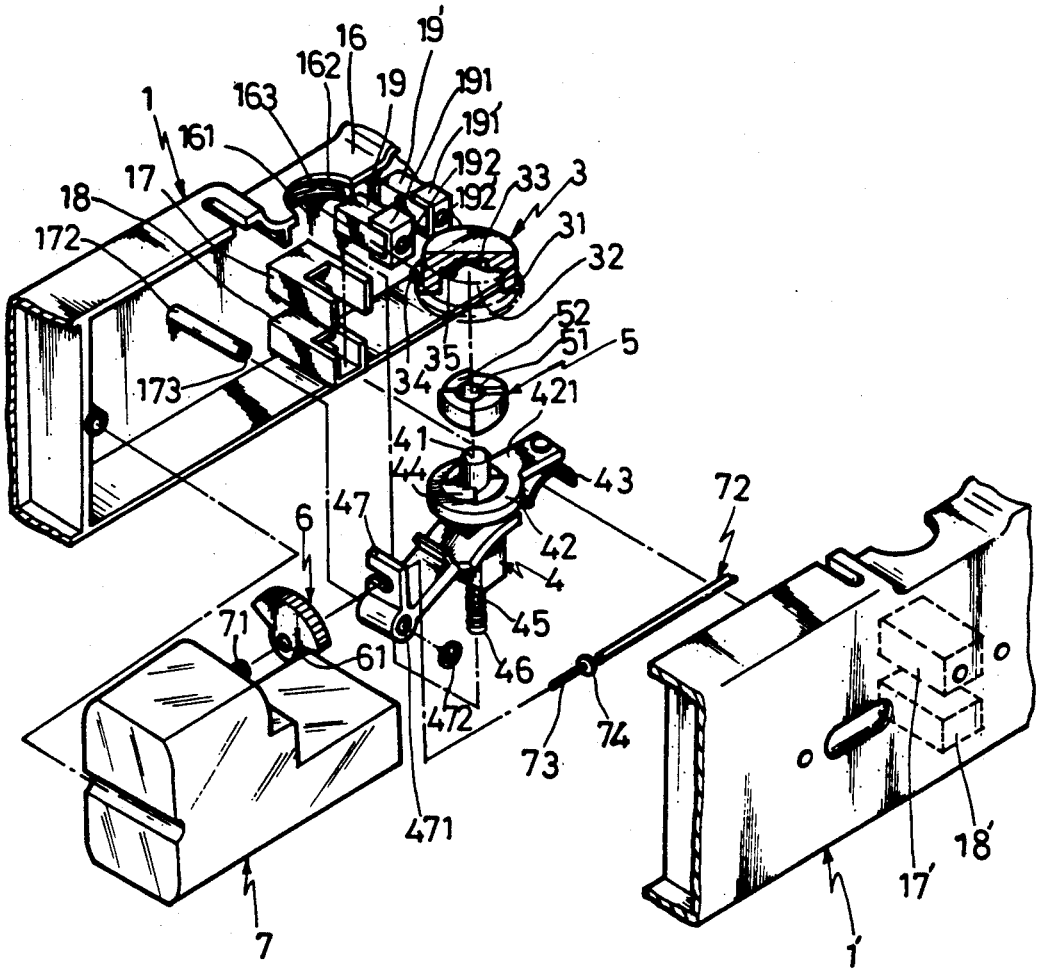
FIG. 7 is a perspective dismantled view of the safety control mechanism.
Figure 8:
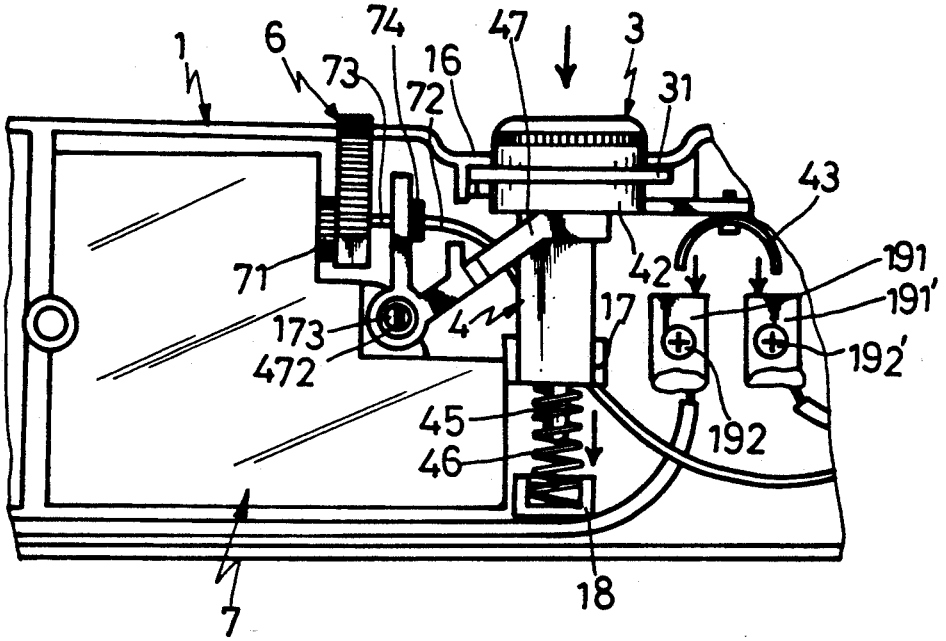
FIG. 8 is a cross-sectional view taken along line 8—8 of FIG. 1 looking in the direction of the arrows.

Referring to FIGS. 7 and 8, the housing of the outer shells 1 and 1' has a recessed surface portion 16 at the top with a hole 161 made thereon, which hole 161 has an annular retaining groove 162 and a stop strip 163 transversely disposed below said annular retaining groove 162. The control knob 3 has a projecting strip 34 projecting outward from the bottom flange 31 thereof, the projecting strip 34 being engageable in the retaining grove 162 when rotated toward the stop strip 163 for inhibiting the push button-type control. When the projecting strip 34 is moved to the stop strip 163 the control knob 3 is prohibited from being pressed down; when the projecting strip 34 is moved away from the stop strip 163 to a predetermined position, the control knob 3 is permitted to be pressed down. By rotating the control knob 3 to the predetermined position, and then pressing it down, gas is discharged and ignited. Inside the housing, here are provided a plurality of U-shaped plug members 17 and 18 respectively made on the first outer shell 1 and respectively fastened in corresponding receptacle members 17' and 18' on the other outer shell 1' which U-shaped plug members 17 and 18 define therein an opening each for holding a control bar 4 which is supported by a spring 46. There are also provided two supports 19 and 19' within the housing of the outer shells 1 and 1' in front of the hole 161 which have each a conductive spring plate 191 or 191' respectively secured thereto by a screw 192 and 192'. When the control knob 3 is rotated to carry the projecting strip 34 away from the stop strip 163 and then pressed down, the extension 421 of the trigger element 42 which is mounted on the control bar 4 is moved to connect the conductive spring plates 191 and 191' through the contact 43, such that ignition process is achieved. At the same time, a link 47 is forced to drive a gas container to discharge gas for combustion.

The control knob 3 defines a space 32 at the bottom and has a recess 33 on the bottom center thereof within said space 32 for engaging the top rod 41 which extends vertically from the control bar 4 at the top. Inside the space 32, there is provided four unitary bevel steps 35 arranged around the periphery of the inner bottom of the control knob 3 for driving a driving element 5. The driving element 5 is comprised of four bevel steps 52 respectively connected one another around a circle and engaged with the four unitary bevel steps 35 of the control knob 3 with a center hole 51 formed through driving element 5, through which center hole 51 the driving element 5 is mounted on the top rod 41 of the control bar 4. Therefore, rotating the control knob 3 causes the driving member 5 to rotate. The trigger element 42 includes four bevel steps 44 arranged around the top rod 41 of the control bar 4 and respectively engaged with the bevel steps 52 of the driving element 5. When the control knob 3 is rotated in clockwise direction, a sound will be produced until it is stopped at a predetermined position. Counter-clockwise rotation of the control knob 3 will also produce a sound before the control knob 3 is stopped. In the present preferred embodiment, the control knob 3 is permitted to rotate through 90° angle in clockwise as well as counter-clockwise direction. When the control knob 3 is rotated, the driving element 5 is carried to rotate while the control bar 4 remains immovable. The spring bar 4 is mounted on a pin 45 fastened inside the housing to automatically push the control bar 4 to move back to original position after each press.

The link 47 has one end connected to the control bar 4, and an opposite end spaced from the control bar 4 with a pivot hole 471 formed therethrough for mounting on a pin rod 172, the pin rod 172 having a notch 173 at one end for coupling with a spring means 472 secured thereto. The link 47 is formed with a lever arm portion for holding a control ring 74. By means of lever effect, the control ring 74 is moved to let gas discharge out of a gas tube 72 responsive to depression of the control knob 3. There is also provided a regulation knob 6 which has a through-hole 61 fastened to a regulating ring 71 which is formed on the gas tube 72 and driven by the regulation knob 6 to regulate gas flow rate through the gas tube 72, which is connected to a gas container 7 through a tube 73.

When not in use, the control knob 3 is rotated to move the projecting strip 34 to engage with the stop strip 163 such that the control knob 3 is locked and cannot be pressed down. Therefore, safety control of the present invention is achieved.

What is claimed is:

1. A safety lighter of the type having an igniting means disposed in an elongated nozzle tube for igniting fuel flowing therethrough, the improvement comprising:

a. a longitudinally extended housing formed by a pair of outer shell members coupled on to the other;

b. a fuel tank disposed within said housing;

c. valve means fluidly coupled to said fuel tank for dispensing fuel therefrom, said valve means including an outlet tube for transporting said dispensed fuel to said nozzle tube;

d. control means operatively coupled to said valve means for dispensing said fuel responsive to displacement of a control knob member extending through an opening formed in said housing, said control knob member displacement being in a direction substantially transverse said longitudinal direction, said control means including (1) a spring biased control bar member coupled to said control knob member for displacement in said transverse direction therewith, (2) a link member having a pair of lever arm portions, each of said lever arm portion being respectively coupled to said valve means and said control bar member for displacing said valve means to control said fuel dispensing responsive to said displacement of said control bar member, and (3) an electrical contact member coupled to a trigger portion of said control bar member for closing an electrical circuit to energize said igniting means substantially simultaneous with said dispensing of said fuel, said control know member having a tab portion extending therefrom, whereby unintentional operation is averted by rotation of said knob member from a predetermined position or displacing said tab into engagement with a slotted opening formed in said housing to thereby prevent said transverse displacement of said control bar member; and, e. means for a rotatively supporting said nozzle tube having a first end coupled to said nozzle tube and a second end pivotedly coupled to said housing through an opening formed therein, said outlet tube extending through said rotatable support means into said nozzle tube, said rotatable support means including a triangularly shaped guide member disposed adjacent said pivotal coupling for rotative displacement within an arcuately contoured groove formed in said housing, said arcuately contoured groove terminating on one end in a triangularly shaped recess for engagement with said guide member.

2. The safety lighter as recited in claim 1 where said control means further includes a driving member disposed between said control knob member and said control bar member, said driving member having a plurality of beveled steps formed on opposing sides thereof for contact with respective beveled steps formed on mating surfaces of said control knob member and said control bar member for generating an audible sound responsive to rotation of said control knob.

3. The safety lighter as recited in claim 2 where said valve means further includes means for regulating a flow rate of said fuel discharged from said outlet tube.

* * * * *